US010107122B2

(12) United States Patent
Maliniak

(10) Patent No.: US 10,107,122 B2
(45) Date of Patent: Oct. 23, 2018

(54) VARIABLE VANE OVERLAP SHROUD

(71) Applicant: United Technologies Corporation, Hartford, CT (US)

(72) Inventor: David Maliniak, Branford, CT (US)

(73) Assignee: United Technologies Corporation, Farmington, CT (US)

( * ) Notice: Subject to any disclaimer, the term of this patent is extended or adjusted under 35 U.S.C. 154(b) by 494 days.

(21) Appl. No.: 14/761,013

(22) PCT Filed: Feb. 4, 2014

(86) PCT No.: PCT/US2014/014536
§ 371 (c)(1),
(2) Date: Jul. 15, 2015

(87) PCT Pub. No.: WO2014/143445
PCT Pub. Date: Sep. 18, 2014

(65) Prior Publication Data
US 2015/0354387 A1 Dec. 10, 2015

Related U.S. Application Data

(60) Provisional application No. 61/762,913, filed on Feb. 10, 2013.

(51) Int. Cl.
*F01D 11/00* (2006.01)
*F01D 17/12* (2006.01)
(Continued)

(52) U.S. Cl.
CPC ..... *F01D 11/005* (2013.01); *F01D 9/041* (2013.01); *F01D 17/12* (2013.01); *F01D 17/162* (2013.01);
(Continued)

(58) Field of Classification Search
CPC ..... F01D 9/041; F01D 11/001; F01D 11/005; F01D 17/12; F01D 17/162; F01D 25/28; F05D 2220/32; F05D 2240/12
See application file for complete search history.

(56) References Cited

U.S. PATENT DOCUMENTS 4,395,195 A * 7/1983 De Cosmo ..... F01D 9/042 415/137
2002/0071764 A1* 6/2002 Turnquist ..... F01D 5/225 415/173.3
(Continued)

FOREIGN PATENT DOCUMENTS

EP 1873355 1/2008

OTHER PUBLICATIONS

The International Search Report and Written Opinion for PCT Application No. PCT/US2014/014536, dated Nov. 11, 2014.
(Continued)

*Primary Examiner* — Richard Edgar
*Assistant Examiner* — Alexander White
(74) *Attorney, Agent, or Firm* — Carlson, Gaskey & Olds, P.C.

(57) ABSTRACT

A shroud supports one of an inner and an outer trunnion on a variable vane. The shroud is provided by a first and a second axial half. Each of the axial halves is provided by a plurality of circumferentially spaced segments. Circumferential edges are defined on each of the plurality of circumferentially spaced segments. Edges between adjacent ones of the circumferentially spaced segments on the first half are circumferentially offset from the edges on adjacent ones of circumferentially spaced segments of the second half, such that no direct leakage path exists across an axial width of the shroud.

20 Claims, 4 Drawing Sheets

(51) Int. Cl.
*F01D 25/28* (2006.01)
*F01D 9/04* (2006.01)
*F01D 17/16* (2006.01)

(52) U.S. Cl.
CPC ..... *F01D 25/28* (2013.01); *F01D 11/001* (2013.01); *F05D 2220/32* (2013.01); *F05D 2240/12* (2013.01)

(56) References Cited

U.S. PATENT DOCUMENTS

2003/0113204 A1 6/2003 Wolf
2009/0208338 A1* 8/2009 Major ..... F01D 11/001
416/215

OTHER PUBLICATIONS

International Preliminary Report on Patentability for International Application No. PCT/US2014/014536 dated Aug. 20, 2015.

* cited by examiner

VARIABLE VANE OVERLAP SHROUD

RELATED APPLICATION

This application claims priority to U.S. Provisional Application No. 61/762,913, filed Feb. 10, 2013.

BACKGROUND OF THE INVENTION

This application relates to a shroud for supporting a variable vane for use in a gas turbine engine wherein leakage paths are eliminated.

Gas turbine engines are known and typically include a fan delivering air into a compressor section where the air is compressed and passed into a combustor section. The air is mixed with fuel and ignited and products of this combustion pass downstream over turbine rotors, driving the turbine rotors to rotate.

The turbine rotors, in turn, drive the fan and compressor section. Historically, a turbine rotor drove a low pressure compressor and a fan at a single speed. More recently, a gear reduction has been placed between the turbine driving the fan and this allows the fan to rotate at slower speeds.

Rotating the fan at slower speeds has allowed the diameter of the fan to increase. It is known for the fan to deliver air into a bypass duct, where it becomes propulsion for an associated aircraft and into a core flow to the compressor. The fans which are provided with a gear reduction may have relatively high bypass ratios, or the volume of the air delivered into the bypass duct compared to the volume of air delivered into the compressor.

As the volume of air delivered into the compressor becomes a smaller percentage, it becomes more and more important to utilize the core air efficiently. The compressor and turbine sections are provided with a plurality of rotating blades and vanes spaced between the rows of the blades. The vanes serve to direct and control the flow of air between stages or rows of the blades.

One type of vane is a variable vane. In a variable vane, a vane is positioned to pivot relative to a radial axis taken from a central axis of the engine. An actuator rotates one side of the vane to pivot and an opposed side of the vane is supported for rotation in a shroud. Typically, the actuator is at a radially outer location.

One known type of shroud has two axially spaced shroud axial halves. These come together to provide a plurality of support locations for the radially inner ends of the vanes. Further, in a split case engine, at least two halves of an engine housing are brought together to define the core engine housing. In such assemblies, each shroud axial half must be formed of at least two circumferential segments.

With various thermal challenges on the shroud, the design has moved such that there are several more circumferential segments. The circumferential segments in each axial half have aligned circumferential edges that combine to create additional leakage paths through the shroud.

When air leaks through the leakage path, the efficiency of driving that air over the vanes and the blades is lost.

SUMMARY OF THE INVENTION

In a featured embodiment, a variable vane assembly has a plurality of vanes with an airfoil extending between an inner trunnion and an outer trunnion. An actuator causes the plurality of airfoils to pivot to change an angle of incidence. A shroud supports one of the inner and outer trunnions. The shroud is provided by a first and a second axial half. The shroud includes a plurality of support surfaces for supporting one of the trunnions. Each of the axial halves is provided by a plurality of circumferentially spaced segments, with circumferential edges defined on each of the plurality of circumferentially spaced segments. Eges between adjacent ones of the circumferentially spaced segments on the first half are circumferentially offset from the edges on adjacent ones of circumferentially spaced segments of the second half, such that no direct leakage path exists across an axial width of the shroud.

In another embodiment according to the previous embodiment, the circumferential edges on the first half are circumferentially spaced from the edges on the second halves by at least a circumferential width of one support surface supporting at least one of the at least one trunnion.

In another embodiment according to any of the previous embodiments, there are alignment and securement structures for securing the first and second halves.

In another embodiment according to any of the previous embodiments, there are at least six of the circumferentially spaced segments in each of the halves.

In another embodiment according to any of the previous embodiments, there are at least six of the circumferentially spaced segments in each of the halves.

In another embodiment according to any of the previous embodiments, there are alignment and securement structures for securing the first and second halves.

In another embodiment according to any of the previous embodiments, there are at least six of the circumferentially spaced segments in each of the halves.

In another featured embodiment, a gas turbine engine has at least one of a compressor and a turbine. The at least one of a compressor and a turbine includes a variable vane assembly, which includes a plurality of vanes with an airfoil extending between an inner trunnion and an outer trunnion. An actuator causes the plurality of airfoils to pivot to change an angle of incidence. A shroud supports one of the inner and outer trunnions. The shroud is provided by a first and a second axial half. The shroud includes a plurality of support surfaces for supporting one of the trunnions. Each of the axial halves is provided by a plurality of circumferentially spaced segments, with circumferential edges defined on each of the plurality of circumferentially spaced segments, and edges between adjacent ones of the circumferentially spaced segments on the first half being circumferentially offset from the edges on adjacent ones of circumferentially spaced segments of the second half, such that no direct leakage path exists across an axial width of the shroud.

In another embodiment according to any of the previous embodiments, the circumferential edges on the first half are circumferentially spaced from the edges on the second half by at least a circumferential width of one support surface supporting at least one of the at least one trunnion.

In another embodiment according to any of the previous embodiments, there are alignment and securement structures for securing the first and second halves.

In another embodiment according to any of the previous embodiments, there are at least six of the circumferentially spaced segments in each of the halves.

In another embodiment according to any of the previous embodiments, there are at least six of the circumferentially spaced segments in each of the halves.

In another embodiment according to any of the previous embodiments, there are alignment and securement structures for securing the first and second halves.

In another embodiment according to any of the previous embodiments, there are at least six of the circumferentially spaced segments in each of the halves.

In another embodiment according to any of the previous embodiments, a method includes the steps of providing a plurality of vanes with an airfoil extending between an inner trunnion and an outer trunnion. An actuator is provided to cause the plurality of airfoils to pivot to change an angle of incidence. One of the inner and outer trunnions in a shroud is supported. The shroud is provided by a first and a second axial half, with the shroud including a plurality of support surfaces for supporting one of the trunnions, and each of the axial halves is provided by a plurality of circumferentially spaced segments, with circumferential edges defined on each of the plurality of circumferentially spaced segments, and edges between adjacent ones of the circumferentially spaced segments on the first half are circumferentially offset from the edges on adjacent ones of circumferentially spaced segments of the second half, such that no direct leakage path exists across an axial width of the shroud.

In another embodiment according to any of the previous embodiments, the circumferential edges on the first half are circumferentially spaced from the edges on the second half by at least a circumferential width of one support surface supporting at least one of the at least one trunnion.

In another embodiment according to any of the previous embodiments, there are alignment and securement structures for securing the first and second halves.

In another embodiment according to any of the previous embodiments, there are at least six of the circumferentially spaced segments in each of the halves.

In another embodiment according to any of the previous embodiments, there are alignment and securement structures for securing the first and second halves.

In another embodiment according to any of the previous embodiments, there are at least six of the circumferentially spaced segments in each of the halves.

These and other features may be best understood from the following drawings and specification.

DETAILED DESCRIPTION

Figure 1:
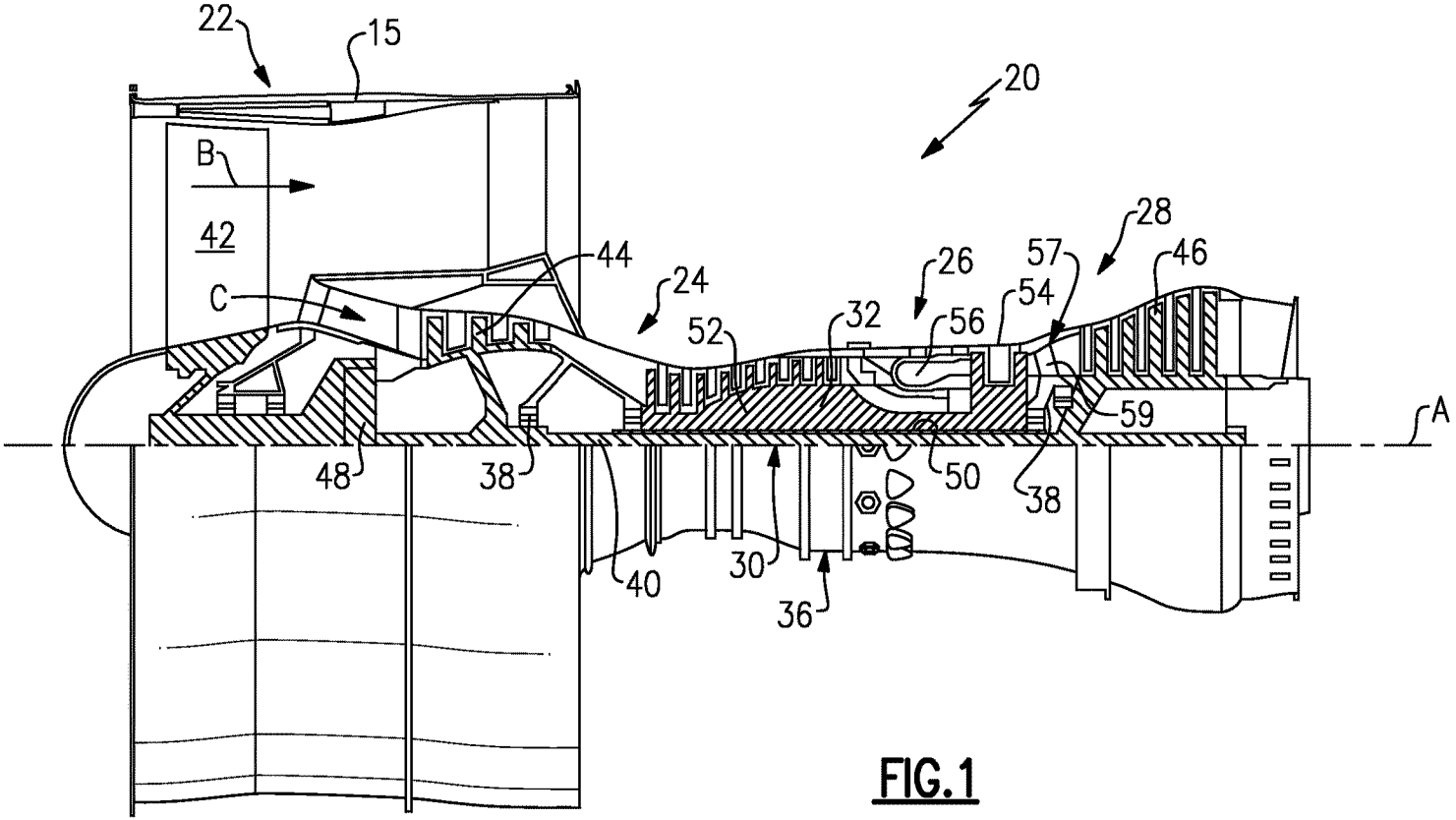
FIG. 1 schematically shows a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion.

The engine 20 in one example is a high-bypass geared aircraft engine. In a further example, the engine 20 bypass ratio is greater than about six (6), with an example embodiment being greater than ten (10), the geared architecture 48 is an epicyclic gear train, such as a planetary gear system or other gear system, with a gear reduction ratio of greater than about 2.3 and the low pressure turbine 46 has a pressure ratio that is greater than about 5. In one disclosed embodiment, the engine 20 bypass ratio is greater than about ten (10:1), the fan diameter is significantly larger than that of the low pressure compressor 44, and the low pressure turbine 46 has a pressure ratio that is greater than about 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second.

Figure 2:
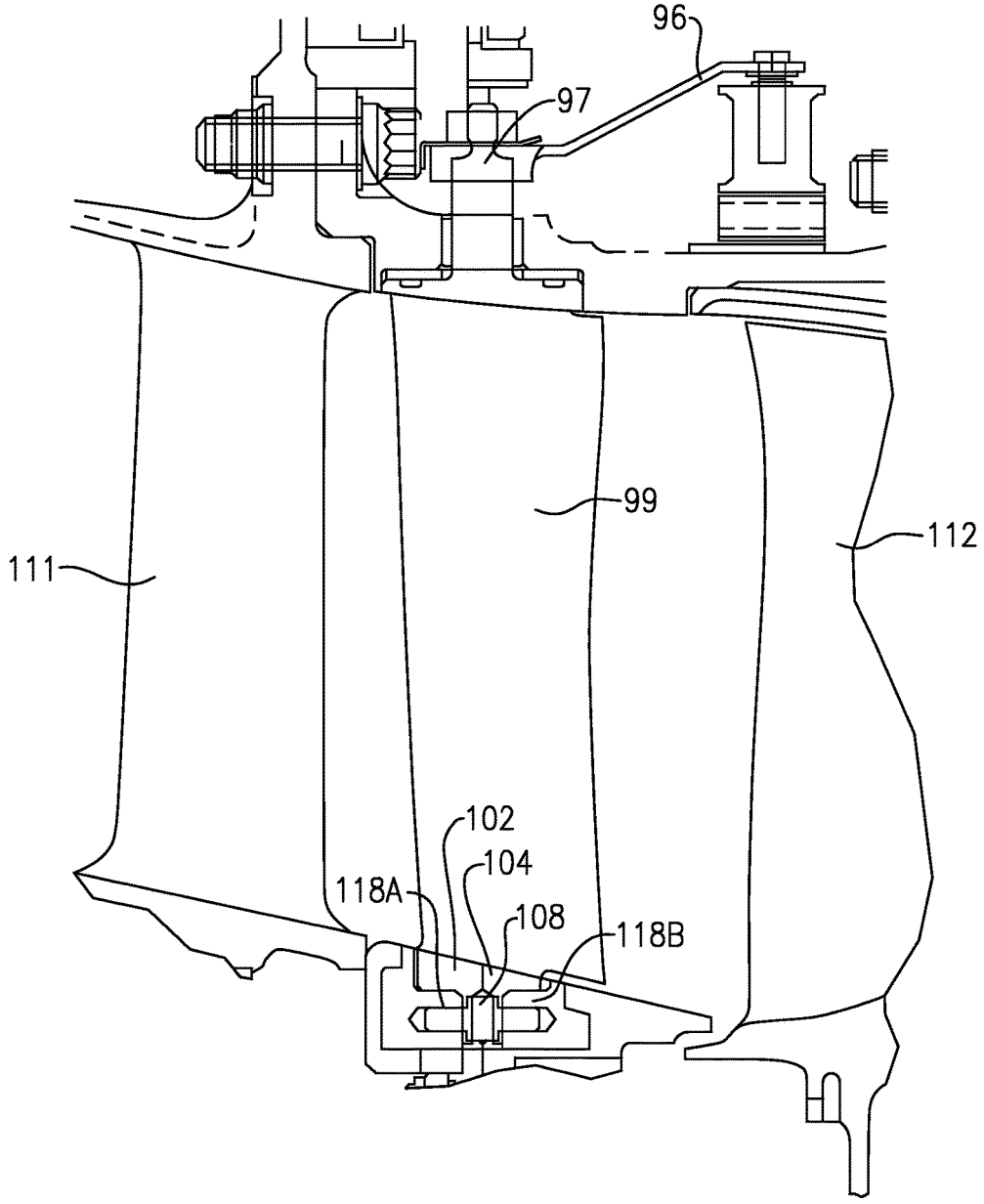
FIG.2 Prior Art
FIG. 2 shows a prior art structure.

FIG. 2 shows a portion of the compressor 24 of FIG. 1. It should be understood that variable vane structures utilized in turbine sections may also benefit from the teachings of this application.

As shown, the compressor section may include static vanes 111 and includes rotor blades 112. A variable vane 99 is positioned upstream of the blade 112 and serves to direct the air flow at the blade 112, such that the air flow is directed as would be desired. During different flow operational conditions, it is desirable to change the angle of incident of the blade 99 to achieve differing flow characteristics. Thus, an upper trunnion 97 of the blade 99 is provided with an adjustment structure 96 that can cause the blade 99 to pivot. An inner end of the blade 99 is received within shroud axial halves 102 and 104, as will be described below. Securement or positioning members 118A, 118B and 108 are shown positioned to connect the shroud axial halves 102 and 104.

Figure 3:
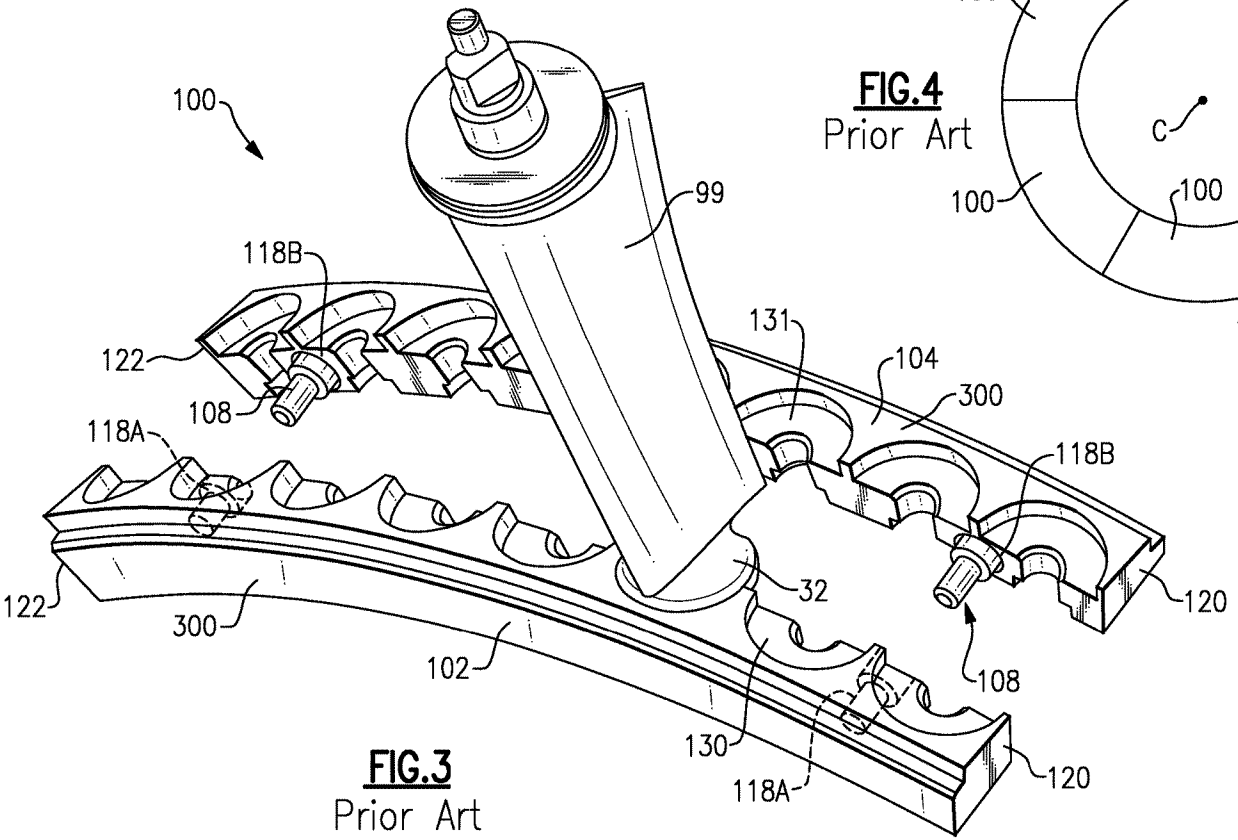
FIG.3 Prior Art
FIG. 3 shows the prior art structure.

As shown in FIG. 3, the shroud axial halves 102 and 104 each are formed from a plurality of circumferential segments 300 that extend between circumferential ends 122 and 120. The alignment structure 108 is secured within recesses 118A and 118B to position and secure the two segments 102 and 104. Support halves 130 and 131 provide a surface to support the inner trunnion 132 of the variable vane 99. The assembled components shown in FIG. 3 make an assembly 100.

Figure 4:
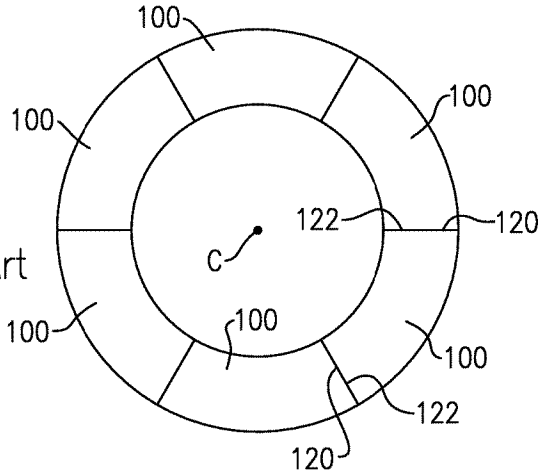
FIG.4 Prior Art
FIG. 4 schematically shows a feature of the prior art.

As shown in FIG. 4, there are as many as six of the assemblies 100 as shown in FIG. 3 spaced circumferentially about a centerline C of an engine. Each of these assemblies 100 have the mating circumferential edges 120 and 122 at circumferentially aligned locations in both of the axial halves 102 and 104. Thus, there are six direct leakage paths across the entire axial width of the shroud assembly in the prior art.

Figure 5:
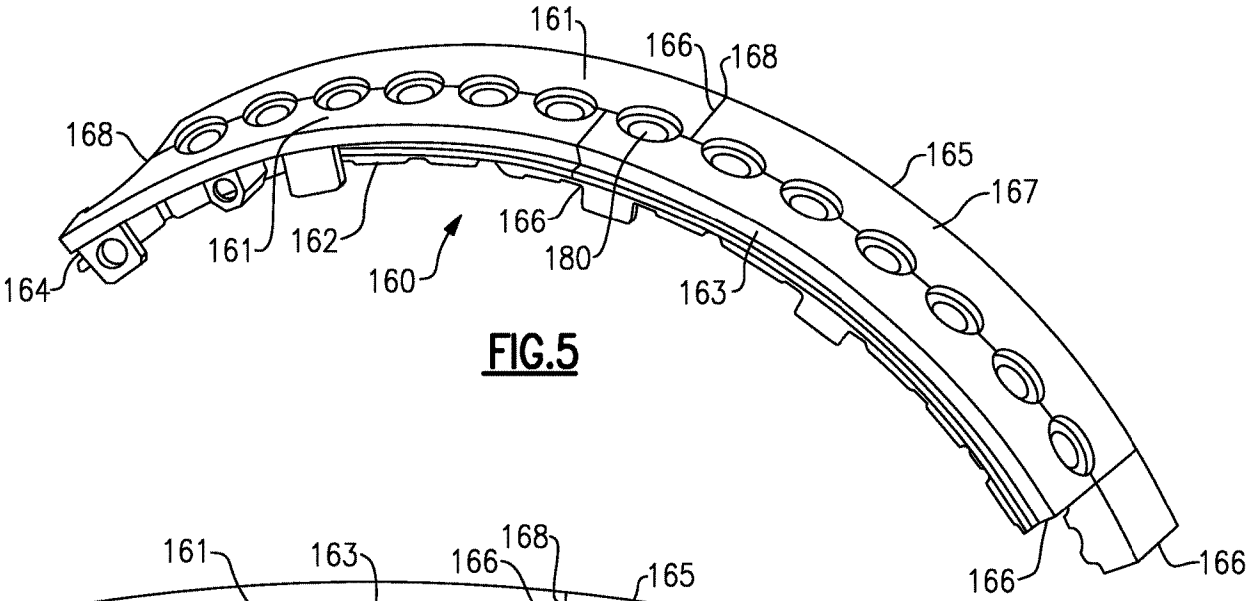
FIG. 5 shows the inventive structure.

FIG. 5 shows an embodiment 160. One circumferential segment 162 has edges 164 and 166 which abut with edges 164 and 166 of an adjacent axial shroud segment 163 on axial half 161. The other axial half 167 of the shroud is provided by circumferential segments 161 and 165. Segments 161 and 165 have edges 168 and 166. As can be appreciated from FIG. 5, the location of the abutting edges 164 and 166 is circumferentially offset from the location of the edges 166 and 168. This offset is at least by one entire support surface 180.

Figure 6:
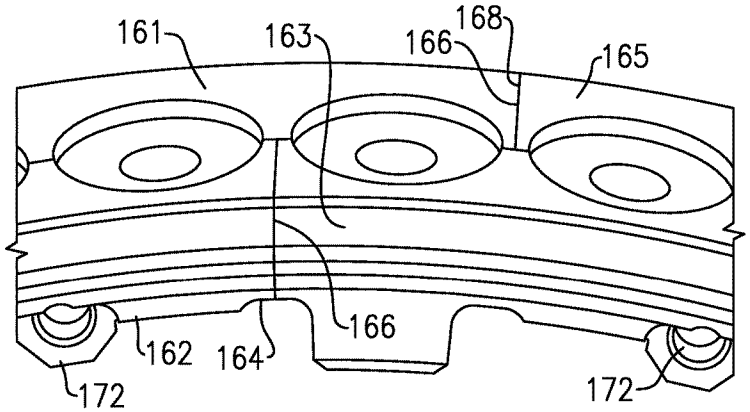
FIG. 6 is a detail of the inventive structure.

As shown in FIG. 6, securement locations 172 may receive bolts to secure the halves 161, 162, 163 and 165. Alternatively, securement members, such as shown in FIG. 3, may be utilized. However, the location of the securement members must be selected to account for the difference in the location of the edges between the two halves 161 and 167.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A variable vane assembly comprising:

a plurality of vanes having an airfoil extending between an inner trunnion and an outer trunnion;

an actuator for causing said plurality of airfoils to pivot to change an angle of incidence; and a shroud supporting one of said inner and outer trunnions, said shroud being provided by a first and a second axial half, with said shroud including a plurality of support surfaces for supporting said one of said trunnions, and each of said axial halves being provided by a plurality of circumferentially spaced segments, with circumferential edges defined on each of said plurality of circumferentially spaced segments, and edges between adjacent ones of said circumferentially spaced segments on said first half being circumferentially offset from the edges on adjacent ones of circumferentially spaced segments of said second half, such that no direct leakage path exists across an axial width of said shroud.

2. The variable vane assembly as set forth in claim 1, wherein said circumferential edges on said first half is circumferentially spaced from the edges on said second halves by at least a circumferential width of one support surface supporting at least one of said at least one of said trunnions.

3. The variable vane assembly as set forth in claim 2, wherein there are alignment and securement structures for securing said first and second halves.

4. The variable vane assembly as set forth in claim 3, wherein there are at least six of said circumferentially spaced segments in each of said halves.

5. The variable vane assembly as set forth in claim 2, wherein there are at least six of said circumferentially spaced segments in each of said halves.

6. The variable vane assembly as set forth in claim 1, wherein there are alignment and securement structures for securing said first and second halves.

7. The variable vane assembly as set forth in claim 1, wherein there are at least six of said circumferentially spaced segments in each of said halves.

8. A gas turbine engine comprising:

at least one of a compressor and a turbine;

said at least one of a compressor and a turbine including a variable vane assembly, the variable vane assembly including a plurality of vanes having an airfoil extending between an inner trunnion and an outer trunnion;

an actuator for causing said plurality of airfoils to pivot to change an angle of incidence; and a shroud supporting one of said inner and outer trunnions, said shroud being provided by a first and a second axial half, with said shroud including a plurality of support surfaces for supporting said one of said trunnions, and each of said axial halves being provided by a plurality of circumferentially spaced segments, with circumferential edges defined on each of said plurality of circumferentially spaced segments, and edges between adjacent ones of said circumferentially spaced segments on said first half being circumferentially offset from the edges on adjacent ones of circumferentially spaced segments of said second half, such that no direct leakage path exists across an axial width of said shroud.

9. The gas turbine engine as set forth in claim 8, wherein said circumferential edges on said first half is circumferentially spaced from the edges on said second halves by at least a circumferential width of one support surface supporting at least one of said at least one of said trunnions.

10. The gas turbine engine as set forth in claim 9, wherein there are alignment and securement structures for securing said first and second halves.

11. The gas turbine engine as set forth in claim 10, wherein there are at least six of said circumferentially spaced segments in each of said halves.

12. The gas turbine engine as set forth in claim 9, wherein there are at least six of said circumferentially spaced segments in each of said halves.

13. The gas turbine engine as set forth in claim 8, wherein there are alignment and securement structures for securing said first and second halves.

14. The gas turbine engine as set forth in claim 8, wherein there are at least six of said circumferentially spaced segments in each of said halves.

15. A method including the steps of:

providing a plurality of vanes having an airfoil extending between an inner trunnion and an outer trunnion;

providing an actuator for causing said plurality of airfoils to pivot to change an angle of incidence; and supporting one of said inner and outer trunnions in a shroud, said shroud being provided by a first and a second axial half, with said shroud including a plurality of support surfaces for supporting said one of said trunnions, and each of said axial halves being provided by a plurality of circumferentially spaced segments, with circumferential edges defined on each of said plurality of circumferentially spaced segments, and edges between adjacent ones of said circumferentially spaced segments on said first half being circumferentially offset from the edges on adjacent ones of circumferentially spaced segments of said second half, such that no direct leakage path exists across an axial width of said shroud.

16. The method as set forth in claim 15, wherein said circumferential edges on said first half is circumferentially spaced from the edges on said second halves by at least a circumferential width of one support surface supporting at least one of said at least one of said trunnions.

17. The method as set forth in claim 16, wherein there are alignment and securement structures for securing said first and second halves.

18. The method as set forth in claim 16, wherein there are at least six of said circumferentially spaced segments in each of said halves.

19. The method as set forth in claim 15, wherein there are alignment and securement structures for securing said first and second halves.

20. The method as set forth in claim 15, wherein there are at least six of said circumferentially spaced segments in each of said halves.

* * * * *